US006162028A

United States Patent [19]

Rembold

[11] Patent Number: 6,162,028

[45] Date of Patent: Dec. 19, 2000

[54] FUEL PUMPING DEVICE FOR TWO-STROKE ENGINES WITH AN ADDITIONAL DRIVING UNIT

[75] Inventor: Helmut Rembold, Stuttgart, Germany

[73] Assignee: Robert Bosch GmbH, Stuttgart, Germany

[21] Appl. No.: 09/230,552

[22] PCT Filed: Jul. 23, 1997

[86] PCT No.: PCT/DE97/01557

§ 371 Date: Jan. 28, 1999

§ 102(e) Date: Jan. 28, 1999

[87] PCT Pub. No.: WO98/05860

PCT Pub. Date: Feb. 12, 1998

[30] Foreign Application Priority Data

Aug. 2, 1996 [DE] Germany ..... 196 31 287

[51] Int. Cl.[7] ..... F04B 17/00; F04B 43/06

[52] U.S. Cl. ..... 417/413.1; 417/380; 417/395; 123/73 C; 123/73 AD

[58] Field of Search ..... 417/413.1, 380, 417/384, 46, 395, 214; 123/73 C, 73 AD, 179.14, 500, 504

[56] References Cited

U.S. PATENT DOCUMENTS

| | | | |
|---|---|---|---|
| 4,022,174 | 5/1977 | Brinkman | 123/448 |
| 4,086,036 | 4/1978 | Hagen et al. | 417/413.1 |
| 4,813,391 | 3/1989 | Geyer et al. | 123/73 C |
| 5,197,417 | 3/1993 | Tuckermann et al. | 123/73 C |
| 5,315,968 | 5/1994 | Niebrzydoski | 123/73 C |
| 5,735,250 | 4/1998 | Rembold et al. | 123/504 |

FOREIGN PATENT DOCUMENTS

| | | |
|---|---|---|
| 2 248 584 | 4/1974 | Germany . |
| 195 27 629 A1 | 1/1997 | Germany . |

*Primary Examiner*—Teresa Walberg
*Assistant Examiner*—Jeffrey Pwu
*Attorney, Agent, or Firm*—Michael J. Striker

[57] ABSTRACT

The invention relates to a fuel pumping device for two-cycle engines with at least a one-piece housing, on which a pulse air connector (14), which is pneumatically connected with the crankcase of the two-cycle engine, a fuel aspiration connector and a fuel pressure connector are arranged, in which a diaphragm (41) on which pulse air acts, drives a pump piston (22) in connection with a diaphragm disk (42), in the course of which fuel being supplied from the tank (1) at the fuel aspiration connector during the pump aspiration stroke is aspirated via a flap valve (61) into the compression chamber (51) located upstream of the pump piston, and is pumped during the compression stroke via a further flap valve (71) into the fuel pressure connector and into a reservoir (73) and/or an injection valve (5). The pulse air connector (14) terminates in a housing chamber (13) located between the diaphragm (41) and the pump piston (22), and at least one spring element (15, 35, 94) acts on each side of the diaphragm (41). Here, the spring element (15) arranged in the housing chamber (13) is supported on the diaphragm (41) via the separate pump piston (22). An electromagnetic drive unit (90) is arranged in the housing chamber (33) located on the other side of the diaphragm (41), which via its armature (91) supports the compression stroke of the pump piston (22) synchronously with the compression stroke of the two-cycle engine.

12 Claims, 1 Drawing Sheet

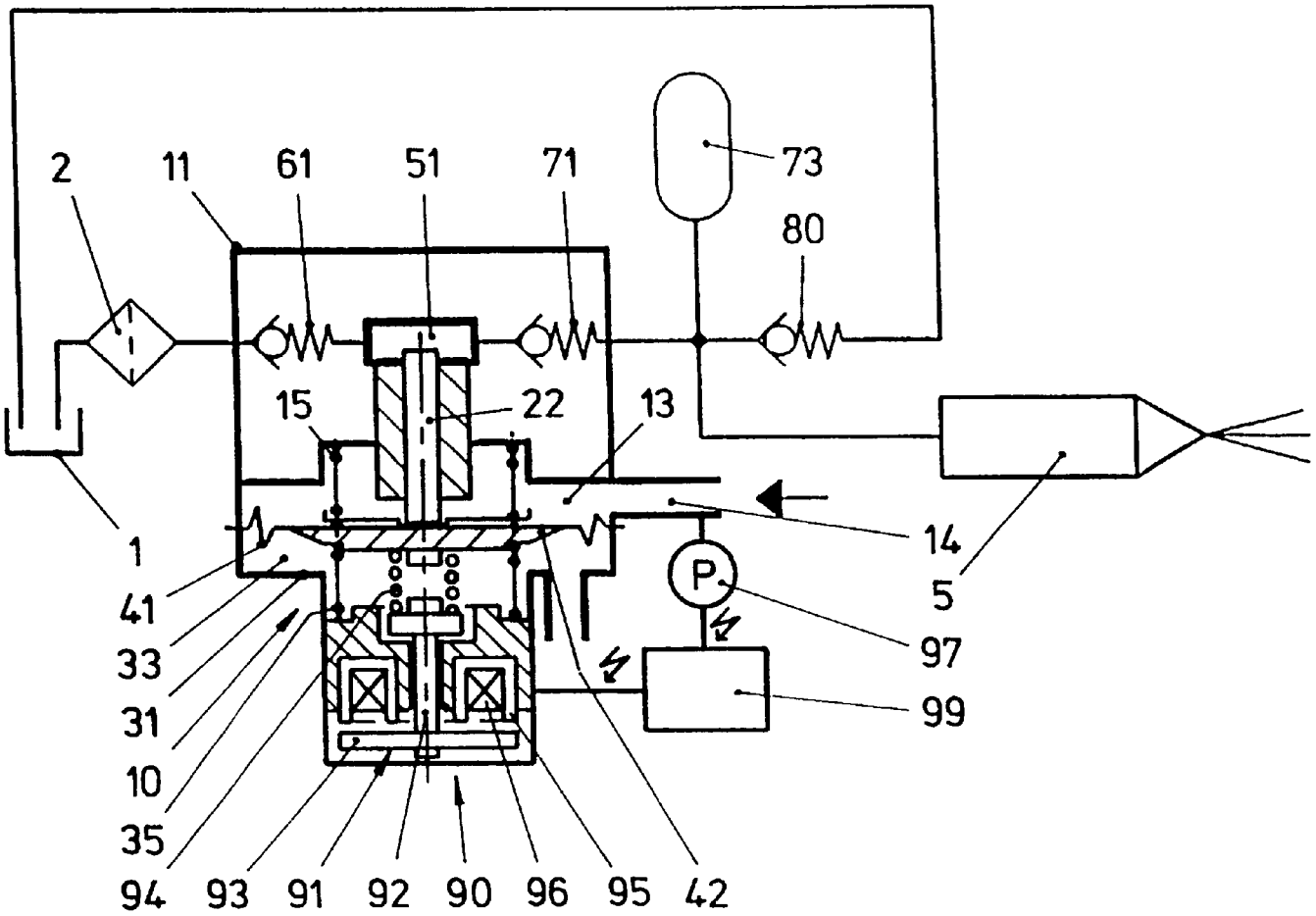
Figur 1

FUEL PUMPING DEVICE FOR TWO-STROKE ENGINES WITH AN ADDITIONAL DRIVING UNIT

BACKGROUND OF THE INVENTION

The invention is based on a fuel pumping device for an internal combustion engine operating in accordance with the two-cycle principle.

Such a fuel pumping device is known from DE 37 27 266 A1. This document describes a diaphragm piston pump, which delivers and compresses fuel for operating an injection device. To this end, the fuel is supplied to the diaphragm piston pump from a fuel tank via a pre-delivery pump. The fuel which is compressed there is delivered to the injection valve. The diaphragm piston pump is provided with motive force by the pulse air diverted out of the crankcase of the internal combustion engine. To this end a diaphragm is seated on the piston compressing the fuel, on which the pulse air acts on the side facing away from the piston. The overpressure being created in the crankcase during a combustion cycle actuates the compression piston. A mechanical spring, together with the underpressure in the crankcase during the compression cycle of the two-cycle engine, performs the return stroke of the compression piston.

A comparable diaphragm piston pump for a fuel injection device is described in DE 41 25 593 A1, wherein the return stroke of the compression-piston takes place by means of a leaf spring package. The spring rate of the leaf spring package can be mechanically changed by means of an adjustment screw.

SUMMARY OF THE INVENTION

The fuel pumping device in accordance with the invention contains at least one diaphragm piston pump, wherein the pulse air connection terminates in a housing chamber located between the diaphragm and the pump piston. At least one spring element acts on each side of the diaphragm, wherein the spring element arranged in the housing chamber is supported on the diaphragm via the separate pump piston. The pulse air is in direct connection with the pump piston in this structural variant. For one, this has the advantage that the oil-containing pulse air flowing in from the crankshaft lubricates the moving parts in this housing section, so that the spring supports and the seal between the pump piston and the housing element guiding it undergo less wear. For another thing, in case of a leak between the pump piston and the housing element guiding it, the fuel coming out there is aspirated during the compression stroke of the two-cycle engine. Therefore the fuel does not get to the outside as in the known diaphragm piston pumps.

In addition, the fuel pumping device is equipped with a drive unit which supports it at least in the starting and/or the idle phase. The drive unit acts on the pump piston via the diaphragm by means of a pressurizing tappet, which oscillates synchronously with the pressure pulsation of the amount of gas enclosed in the crankcase. By means of this a minimum injection pressure required for the operation of the two-cycle engine is generated at least during the starting and/or idling rpm, i.e. during low pressure pulsation.

The drive unit can be a permanent magnet generator, for example, which supplies the magnet with the required energy at respectively the correct time. The dynamic tuning of the electro-magnetic actuator preferably takes place in respect to the optimal function during starting, or respectively idling. The electrical support is no longer needed at higher engine rpm. The pressure pulsation is sufficient for generating the minimum injection pressure.

The pressurizing tappet of the drive unit can of course also be supported on the single spring element which, inter alia, causes the compression stroke of the pump piston.

Furthermore, with the diaphragm piston pump introduced here, there is no rigid mechanical connection between the pump piston and the diaphragm on which the pulse air acts, or respectively its diaphragm disk. The stroke of the diaphragm is transferred, free of lateral forces, to the pump piston. This also reduces the wear on the pump.

The diaphragm piston pump can be equipped with a manual key. To this end, the pressurizing tappet of the electrical drive unit is extended out of the housing part located opposite the rear of the diaphragm in the form of a manual key, for example. Pushing the manual key causes a compression stroke of the pump piston. In this way it is possible, for example in connection with small two-cycle engines, such as are used in manually guided working devices, to pre-fill the injection line and the injection valve after the fuel tank has been completely emptied, or after a prolonged idle period, so that the starting process is shortened.

The described diaphragm piston pump is constructed in such a way that the valves and the compression chamber can be separated from the components surrounding the diaphragm and guiding the pump piston. For one, this eases maintenance and repair, and also the fabrication.

BRIEF DESCRIPTION OF THE DRAWINGS

Further details of the invention ensue from the following description of an embodiment represented schematically:

FIG. 1: fuel pumping device for direct injection;

DESCRIPTION OF THE PREFERRED EMBODIMENT

FIG. 1 represents the functional diagram of a fuel pumping device for a direct injection system, such as can be used in connection with two-cycle engines. Fuel pressure is generated by means of a diaphragm piston pump (10). The diaphragm piston pump (10) aspirates the fuel from a fuel tank (1) by means of a suction valve (61) arranged inside a pump housing (11), for example via a filter (2). The aspirated fuel reaches a compression chamber (51), into which a pump piston (22) dips. The fuel displaced there flows via a pressure valve (71) into a fuel pressure reservoir (73) and to an injection valve (5), which for example is electrically controlled. On the pressure side, a portion of the fuel escapes, if needed, via a pressure control valve (80), for example into the fuel tank (1).

With its rear, the pump piston (22) projects into the chamber (13) of the pump housing (11), which is pneumatically connected with the crankcase of the internal combustion engine operating in accordance with the two-cycle principle. In this pulse air chamber (13), the pump piston is pressed by means of a spring element (15) against a diaphragm (41), which has been reinforced with a diaphragm disk (42). An ambient air chamber (33), in which two further spring elements (35) and (94) are arranged, is located on the rear of the diaphragm (41) and is enclosed by a housing cover (31). Both spring elements (35, 94) act counter to the other spring element (15). The prestressed spring elements (15, 35, 94) maintain the diaphragm (41) in a center position as long as the same air pressure prevails on both sides of the diaphragm (41) and a drive unit (90), arranged on the housing cover (31), is shut off and in a position of rest.

The drive unit (90) is a solenoid, which has a pressurizing tappet (91) as the armature. The pressurizing tappet (91), which arranged coaxially with the pump piston (22) in the housing cover (31), consists of a shaft (92) and a yoke plate (93). The shaft (92) acts directly on the spring element (94). A coil (96) is arranged around it in a pot core (95).

When the two-cycle engine is running, pulse air flows under overpressure into the pulse pressure chamber (13) and moves the diaphragm (41) downward, in the course of which the pump piston (22) is made to follow the diaphragm (41) by the spring element (15) and the spring element (35) is tensed further. The diaphragm piston pump (10) aspirates fuel into the compression chamber (51) via a suction valve (61). As soon as the overpressure drops, the partially relaxing spring elements (35, 94) push the pump piston (22) into the compression chamber (51). The fuel flows via the pressure valve (71) to the injection valve (5) and/or to the fuel pressure reservoir (73). The compression stroke extends past the center position of the diaphragm (41), since toward the end of the stroke the underpressure now prevailing in the crankcase acts on the diaphragm (41). The diaphragm (41) is sucked upward.

The pumping movement of the pump piston (22) is repeated with the increase in the pulse air pressure.

The coil (96) is provided with current synchronously with the compression stroke at least in the starting or idling phase. In the course of this the yoke plate (93) is pulled against the pot core (95), because of which the pressurizing tappet (91) tighten the spring element (94) against the diaphragm (41) and in this way additionally supports the compression stroke of the pump piston (22).

The current supply to the coil is induced by a control device (99). A pressure sensor (97) which, for example, is pneumatically connected with the pulse air connector (14), issues the signal for supplying the current.

What is claimed is:

1. A fuel pumping device for two-cycle engines, comprising at least a one-piece housing having a compression chamber, a first housing chamber, and a second housing chamber; connector means arranged on said housing and including a pulse air connector which is pneumatically connectable with a crankshaft of the two-cycle engine, a fuel aspiration, and a fuel pressure connector; flap valve means including a first flap connector valve and a second flap valve; a pump piston; a diaphragm on which pulse air acts and which drives said pump piston so that fuel being supplied at said fuel aspiration connector during a pump aspiration stroke is aspirated via said first flap valve into said compression chamber which is located upstream of said pump piston and is pumped during a compression stroke via said second flap valve into said fuel pressure connector, said pulse air connector terminating in said first housing chamber into which said pump piston also projects and which is bordered on one side by said diaphragm; an externally actuated drive unit having a pressurizing tappet; spring means acting on each side of said diaphragm, said spring means including a first spring element arranged in said first housing chamber and supported on said diaphragm via a separate pump piston, and a second spring element supported at least during low engine rpm on said pressurizing tappet of said externally actuated drive unit, which acts in a compression direction during a compression stroke of said pump piston, said spring elements being prestressed and maintaining said diaphragm in a center position if the same air pressure prevails on both sides of said diaphragm and, when said drive unit is attached, it is turned off and is in a position of rest, so that during a suction stroke and a pressure stroke said diaphragm can move past the center position.

2. A fuel pump device as defined in claim 1, wherein said second spring element is arranged in said second housing chamber located on a rear of said diaphragm.

3. A fuel pump device as defined in claim 1, wherein said second spring element is connected parallel with said diaphragm.

4. A fuel pump device as defined in claim 1, wherein said drive unit is an electromagnet.

5. A fuel pump device as defined in claim 4, wherein said electromagnet has a coil arranged in a pot core.

6. A fuel pump device as defined in claim 4, wherein said electromagnet has an armature as said pressurizing tappet, which is formed of a cylindrical shaft and a disk-shaped yoke plate arranged on said cylindrical shaft.

7. A fuel pump device as defined in claim 4; and further comprising a control device which excites said electromagnet during the compression stroke in a cycle of a pressure pulsation in a crank, case of the two-cycle engine.

8. A fuel pump device as defined in claim 7; and further comprising a sensor which detects the cycle.

9. A fuel pump device as defined in claim 7; and further comprising an ignition device which detects the cycle.

10. A fuel pump device as defined in claim 7; and further comprising a reference marker signal on a crankshaft which detects the cycle.

11. A fuel pump device as defined in claim 8, wherein said sensor is a pressure sensor arrangeable in the crank, case of the two-cycle engine in a pneumatic line to said first housing chamber.

12. A fuel pump device as defined in claim 8, wherein said sensor is a pressure sensor arrangeable in the crank, case of the two-cycle engine in said first housing chamber.

* * * * *